United States Patent [19]

Travis

[11] 4,306,477

[45] Dec. 22, 1981

[54] TICKET DISPENSER

[75] Inventor: Glenn W. Travis, Dunwoody, Ga.

[73] Assignee: Sew Simple Systems, Inc., Fountain Inn, S.C.

[21] Appl. No.: 159,688

[22] Filed: Jun. 16, 1980

[51] Int. Cl.[3] ..... B26D 5/22

[52] U.S. Cl. ..... 83/205; 83/277; 226/115; 226/151; 226/162; 226/167

[58] Field of Search ..... 83/203, 205, 277; 226/115, 116, 151, 162, 165, 166, 167

[56] References Cited

U.S. PATENT DOCUMENTS

| | | | |
|---|---|---|---|
| 1,261,310 | 4/1918 | Smith | 83/277 |
| 3,165,207 | 1/1965 | Campbell | 83/277 X |
| 3,667,331 | 6/1972 | Regec et al. | 83/277 X |

*Primary Examiner*—James M. Meister

*Attorney, Agent, or Firm*—Jones, Thomas & Askew

[57] ABSTRACT

The ticket dispenser includes lower and upper overlying support plates which define a ticket material passageway therebetween. A reel support is mounted on one end and cutting apparatus are mounted on the other end of the support plates. A feed slot is formed in the upper support plate and a feed pawl reciprocates in the feed slot. A feed pawl cam urges the feed pawl downwardly into engagement with the ticket material in the passageway as the feed pawl moves toward the cutting apparatus, and urges the feed pawl upwardly away from the ticket material as the feed pawl moves away from the cutting apparatus. As the feed pawl reaches the end of its feeding stroke, the cutting apparatus cuts off the portion of the ticket material that has been pushed beyond the cutting means, and feed out apparatus pulls additional ticket material from the reel.

7 Claims, 5 Drawing Figures

TICKET DISPENSER

BACKGROUND OF THE INVENTION

This invention relates to ticket dispensing apparatus of the type that urges ticket material along its length from a supply beyond a cutting means, and actuates the cutting means to cut off the projected end portion of the ticket material, to discharge the cut ticket to a desired location.

Ticket dispensing equipment is used in various commerical environments including locations where people are admitted to various functions by purchasing tickets, and in industrial production situations where tickets are dispensed in a manufacturing process to the goods being manufactured. For example, various garment and flat goods producers deposit tickets in or to the produced goods to show that the goods have been inspected. Typically, the tickets being dispensed will include a statement such as "inspected by Inspector No. 2". In some cases, cleaning instructions or other information is included on the tickets.

When ticket dispensers are used in a manufacturing process, it is important that the dispenser be able to run rapidly and continually without monitoring so as to reliably dispense its tickets. Also, it is important that the ticket dispenser can be rapidly reloaded with an additional supply of ticket material. Usually, the ticket material is inexpensive and is formed without notches or other features that would enable the dispenser to cut the ticket material at the proper location along the length of the ticket material. Thus, it is desirable that the dispensers used in a manufacturing process be reliable to index the ticket material a predetermined length during each dispensing function so that the information on each ticket cut from the dispenser is substantially centered in the ticket.

SUMMARY OF THE INVENTION

Briefly described, the present invention comprises ticket dispensing apparatus which continually and accurately dispenses and cuts ticket material for prolonged periods without requiring resupply of ticket material. The ticket dispensing apparatus comprises a pair of parallel, overlying supports that define a ticket material passageway therebetween, and a reel of ticket material is supported at one end of the support plates and cutting means is positioned at the other end of the support plates. And indexing or feed pawl is reciprocatably supported on the upper support plate and extends through an elongated slot of the support plate over the ticket material passageway. An indexing pawl cam is also positioned at the slot and defines an opening therein through which the indexing pawl moves. The cam urges the pawl downwardly toward engagement with the ticket material as the pawl moves toward the cutting means and lifts the pawl away from the ticket material as the pawl moves away from the cutting means. Ticket material feedout means includes a check pawl for retarding reverse movement of the ticket material and a feedout roller which pulls the ticket material from its reel as the check pawl retards reverse movement of the ticket material.

The lower and upper support platforms are pivotally connected to each other so that the ticket material passageway is accessible to an operator when a new supply of ticket material is to be threaded through the apparatus, thereby permitting rapid resupply of ticket material.

Thus, it is an object of the present invention to provide a ticket dispensing and cutting apparatus which reliably and continually dispenses a predetermined length of ticket material to a cutting means, and the cutting means cuts off the protruding end of the ticket material and permits the cut ticket to drop to a desired location.

Another object of this invention is to provide a ticket dispensing apparatus which can be rapidly reloaded with ticket material and which is suitable for continual operation in a manufacturing process for dispensing and cutting ticket material of the type that does not include alignment notches.

Other objects, features and advantages of the present invention will become apparent upon reading the following specification, when taken in conjunction with the accompanying drawings.

DETAILED DESCRIPTION

Figure 1:
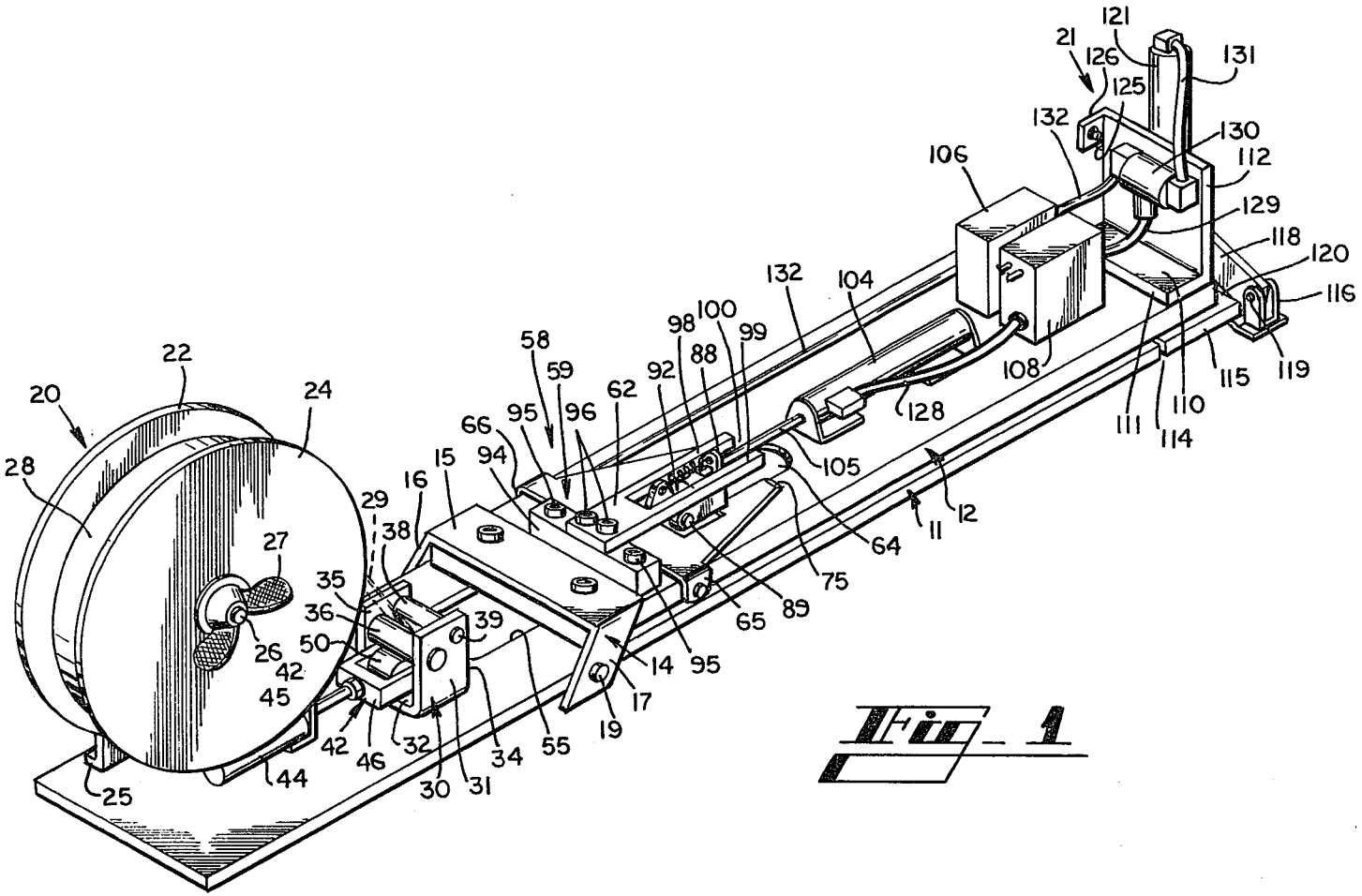
FIG. 1 is a perspective illustration of the ticket dispensing apparatus.
Figure 4:
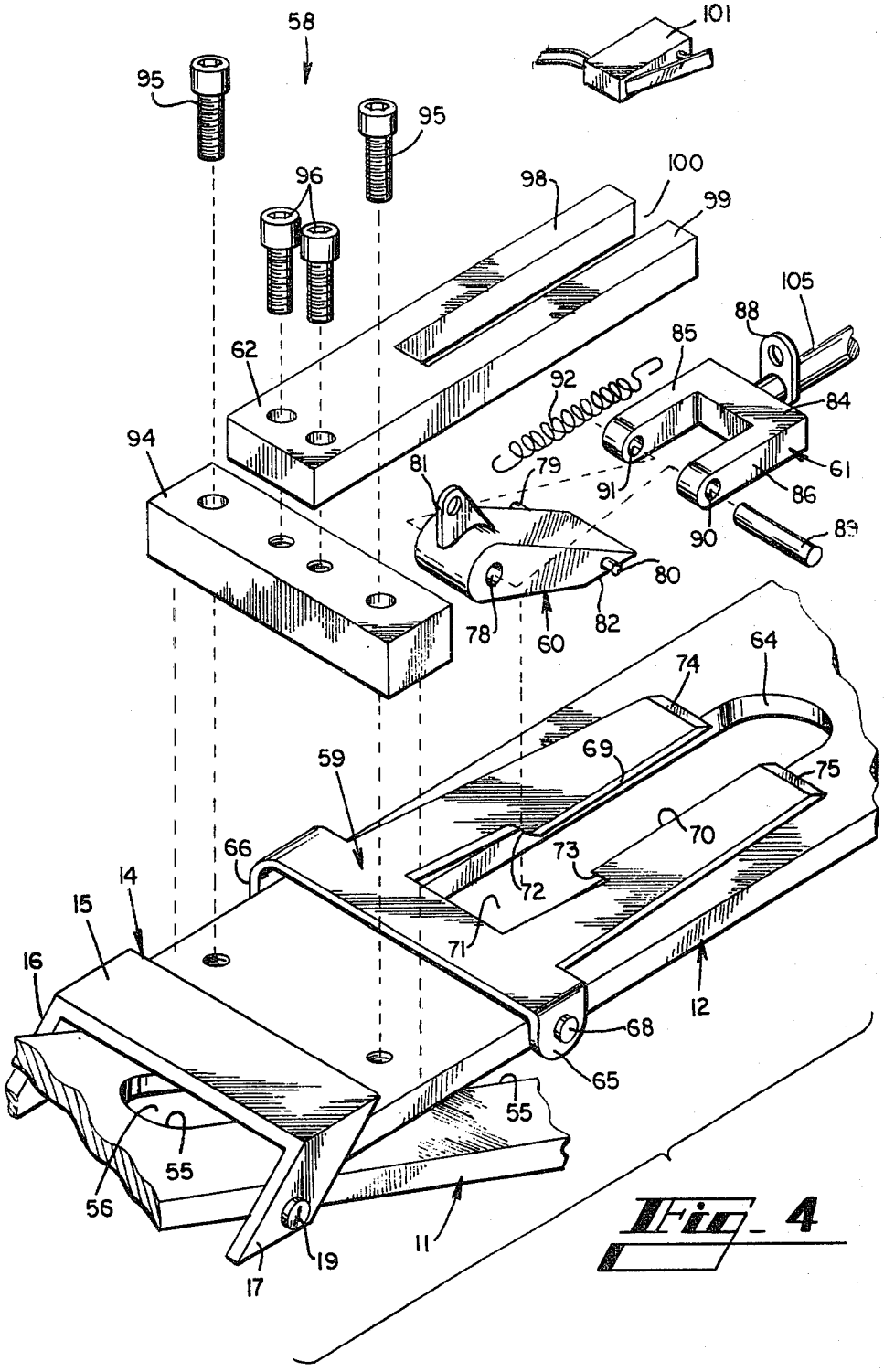
FIG. 4 is an exploded perspective illustration of the indexing means.

Referring now in more detail to the drawings, wherein like numerals indicate like parts throughout the several views, FIG. 1 illustrates the ticket dispenser 10 which includes lower and upper support plates or platforms 11 and 12, both of which are substantially flat, and which are arranged in overlying flat juxtaposition. Upper support plate 12 is shorter than lower support plate 11 and is hingedly connected to lower support plate 11 by means of hinge bracket 14. Hinge bracket 14 is approximately U-shaped, with its horizontal leg 15 rigidly connected to upper support plate 12 and with its side legs 16 and 17 connected at their end portions to pivot pin 19. Pivot pin 19 is mounted to the bottom surface of lower support plate 11, thus causing upper support plate 12 to be pivotable with respect to lower support plate 11 about pivot pin 19 (FIG. 4).

Reel holder 20 is positioned at one end of the lower 11 while cutting means 21 is positioned at the other end thereof. Reel holder 20 comprises a pair of parallel coaxial discs 22 and 24 mounted from one or more support brackets 25, with a connecting bolt 26 extending through support bracket 25 and through center openings in each of the discs 22, 24. A reel of ticket material 28 is positioned between discs 22 and 24, by removing the wing nut 27 of bolt 26 so as to remove disc 24, and inserting the reel 28 about the pin of bolt 26, and then reattaching the discs 24. The free end 29 of the ticket material extends from reel holder 20 and passes through feed out means 30.

Feed out means 30 is positioned between reel holder 20 and hinge bracket 14 and includes an upright support clevis 31 having its bottom wall 32 rigidly mounted to lower support plate 11 and spaced apart parallel side walls 34 and 35 aligned with the discs 22 and 24 of reel holder 20. Rotatable guide roll 36 is mounted at its ends in side walls 34 and 35, and check pawl 38 is pivotably mounted on its pivot pin 39 at the upper forward portion of support clevis 31. The lower end surface 40 of check pawl 38 normally rests adjacent bottom wall 32 of support clevis 31, and coil torsion spring 41 extends about pivot pin 39 and urges the lower end surface 40 against bottom wall 32 of support clevis 31.

Feed out means 30 also includes reciprocatable feed out clevis 42 movably positioned in the lower portion of support clevis 31 beneath rotatable guide roll 36. Pneumatic cylinder 44 has its cylinder rod 45 connected to feed out clevis 42. Feed out clevis 42 is approximately U-shaped and includes base leg 46 and spaced parallel side legs 48 and 49. Movable guide roll 50 is rotatably supported at its ends by spaced parallel side legs 48, 49. The side legs 48, 49 are rounded at their ends 51, 52 and engage the lower portion of check pawl 38, holding the check pawl tilted away from engagement with bottom wall 32 of support clevis 31.

Figures 2, 3, 5:
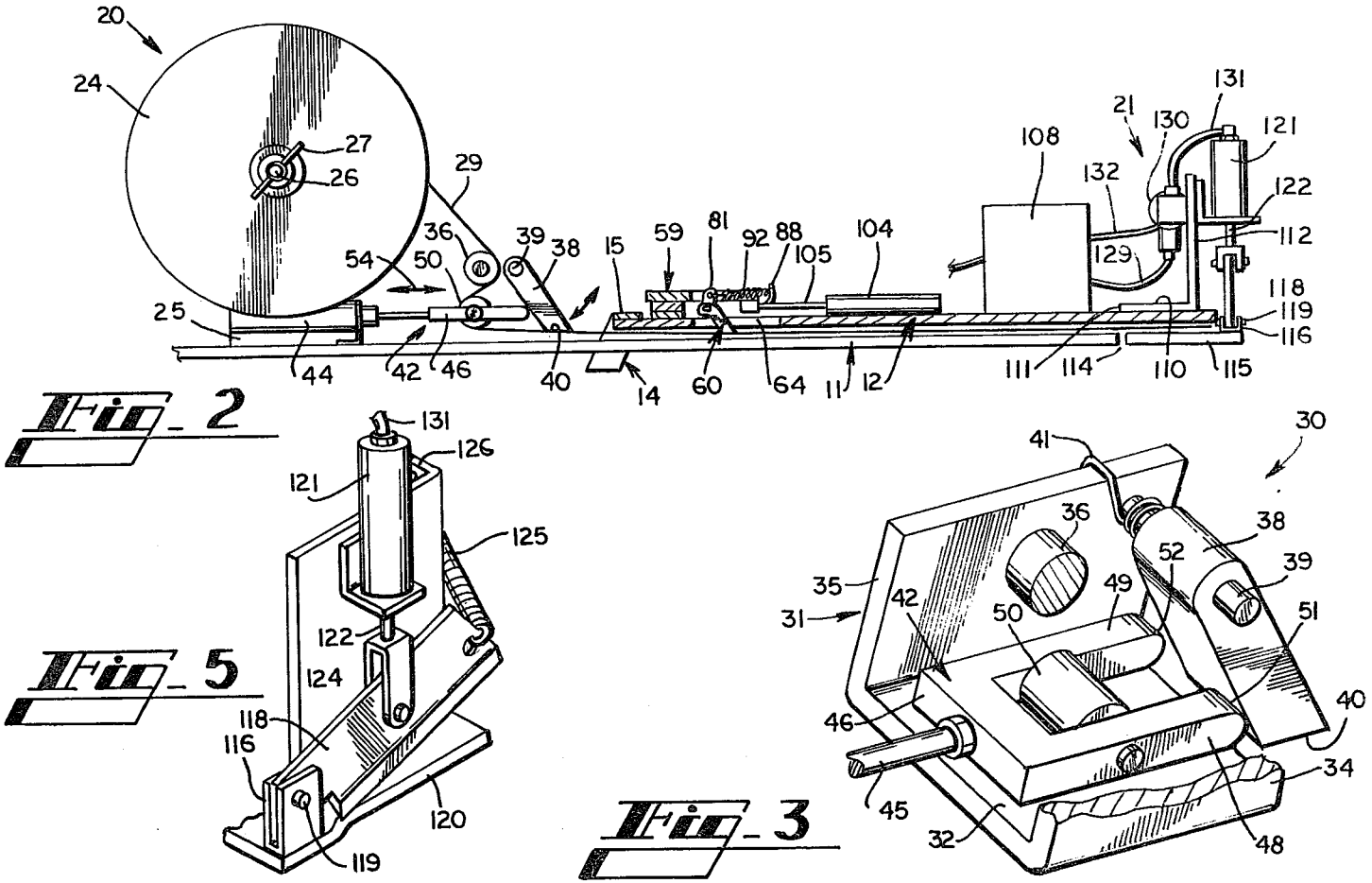
FIG. 2 is a side view, with parts in cross section, of the ticket dispensing apparatus.
FIG. 3 is a detailed perspective illustration, with parts broken away, of the feed out means.
FIG. 5 is a perspective illustration of the cutting means.

As illustrated in FIG. 2, the free end 29 of ticket material is extended from the upper portion of reel holder 20 downwardly in front of and about rotatable guide roll 36, then down and behind movable guide roll 50, and then beneath check pawl 38. Pneumatic cylinder 44 includes an internal coil spring (not shown) that continuously biases feed out clevis 42 toward engagement with check pawl 38, and when cylinder 44 is pressurized, feed out clevis 42 is retracted as indicated by the double headed arrow 54, away from check pawl 38, permitting check pawl 38 to pivot down into engagement with the ticket material to prevent the ticket material from moving backwards, while further rearward movement of the feed out clevis 42 tends to pull the ticket material along its length from reel holder 20.

As illustrated in FIGS. 1 and 4, lower support plate 11 includes an elongated slot 55 therein which extends from a position between feed out means 30 and hinge bracket 14 to the other end of the apparatus. Thus, a recessed bottom wall 56 is formed in the upper surface of lower support plate 11, so that when the lower and upper support plates 11 and 12 are closed together the elongated slot 55 and the bottom surface of the upper support plate 12 together form a track or passageway through which the ticket material is threaded and moves. The slot 55 is of a width slightly wider than the anticipated width of the ticket material.

Ticket material indexing means 58 is mounted on upper support plate 12 and is positioned adjacent hinge bracket 14. Indexing means 58 includes cam plate 59, indexing or feed pawl 60 (FIG. 4), pawl clevis 61, and bifurcated pawl bearing 62. Elongated slot 64 is formed through upper support plate 12 and is aligned over the passageway formed by the elongated slot 55 in the lower support plate 11. Cam plate 59 is substantially flat, extends in flat overlying relationship with respect to upper support plate 11 and includes downwardly turned hinge plates 65 and 66. Hinge pin 68 extends through hinge plate 65 and 66, with hinge pin 68 extending through upper support plate 12. Thus, cam plate 59 is movably supported on upper support plate 12. T-shaped slot 69 is formed through cam plate 59. Slot 69 includes a narrowed passageway 70 which is aligned with the elongated slot 55 of lower support plate 11 when the lower support plate and upper support plate have been closed together, and is aligned with slot 64 in upper support plate 12. The wider head opening 71 of T-shaped slot 69 is also aligned with slot 64. The shoulders 72 and 73 formed at the base of wider head opening 71 are undercut so as to form downwardly tapered cam surfaces. Similar cam surfaces 74 and 75 are formed on the exterior surface of cam plate 59 on opposite sides of the stem portion 70 of the T-shaped slot 69. It will be noted that all cam surfaces 72–75 are slopped downwardly and along the length of the apparatus toward cutting means 21.

Indexing pawl 60 includes hinge pin opening 78 at its upper portion, cam follower stems 79 and 80 protruding from its side surfaces, upper spring bracket 81 and lower ticket engaging surface 82. U-shaped indexing pawl clevis 61 includes base leg 84, parallel spaced side legs 85 and 86, and spring bracket 88. Pivot pin 89 extends through aligned pivot pin openings 90 and 91 and through pivot pin opening 78 of indexing pawl 60, thus pivotably connecting indexing pawl 60 to indexing pawl clevis 61. Coil tension spring 92 extends between spring brackets 81 and 88 so as to pivot the lower ticket engaging surface 82 of indexing pawl 60 downwardly toward engagement with the ticket material 29 present in slot 55 of lower support plate 11.

Support block 94 is rigidly mounted to upper support plate 12 by means of threaded screws 95, and pawl bearing 62 is rigidly mounted to the upper surface of support block 94 by its screws 96. Pawl bearing 62 extends from support block 94 over cam plate 59. Pawl bearing 62 is bifurcated and includes side legs 98 and 99 and defines open slot 100 therebetween. Spring brackets 81 and 88 of indexing pawl 60 and clevis 61 are movable through slot 100, while the bottom surfaces of side legs 98 and 99 are positioned directly over indexing pawl 60 and indexing pawl clevis 61, so as to engage the upper surfaces of these elements should these elements tend to become jacked up during the forward movement of indexing pawl 60. Microswitch 101 is mounted on one of the legs 98, 99 of pawl bearing 62 and is actuated by the movement of indexing pawl 60 as the pawl moves toward the end of its outward stroke.

As illustrated in FIGS. 1 and 2, pneumatic cylinder 104 is mounted to upper support plate 12 and its cylinder rod 105 is connected to indexing pawl clevis 61. Cylinder rod 105 is distended by a coil compression spring (not shown) which is inside pneumatic cylinder 104, and when cylinder 104 is pressurized, cylinder rod 105 retracts against the bias of the spring.

Solenoid valves 106 and 108 are mounted on upper support plate 12 at a position between pneumatic cylinder 104 and cutting means 21.

Cutting means 21 includes L-shaped support plate 110 having its horizontal leg 111 mounted directly to upper support plate 12, with its upwardly extending leg 112 extending substantially perpendicular to the plane of upper support plate 12. Lower support plate 11 is forshortened and terminates at 114 at an area beneath L-shaped support plate 110, and extension 115 is rigidly mounted to upper support plate 12. Extension 115 also includes a slot (not shown) in its surface facing upper support plate 112, so that the slot forms a continuation of slot 55 in lower support plate 11, thereby forming a through passageway to cutting means 21.

Cutting blade support clevis 116 is rigidly mounted to extension 115 and cutting blade 118 is pivotally mounted in clevis 116 by pivot pin 119. Cutting blade 118 is arranged to pivot downwardly with a scissor's action against the edge 120 of extension 115. Pneumatic cylinder 121 is mounted to the upright leg 112 of L-shaped support plate 110, and its cylinder rod 122 is connected to blade 118 by clevis 124. A loose connection is formed between blade 118 and cylinder rod 122, and a loose connection is made between blade 118 and its clevis 116. Coil tension spring 125 is connected at one of its ends to the end of blade 118 and extends approximately horizontally rearwardly for connection to spring support bracket 126. Thus, blade 118 is biased into a scissors relationship with respect to the edge 120 of upper support plate 12.

A source or air pressure is supplied to each of solenoid valves 106 and 108. Outlet conduit 128 extends from solenoid valve 108 to pneumatic cylinder 104. Solenoid valve 106 is placed in a reverse position with respect to solenoid valve 108, and outlet conduit 129 extends from solenoid valve 106 to T-shaped connector 130. One outlet conduit 131 extends from T-shaped connector 130 to the upper end of pneumatic cylinder 121, while the other outlet conduit 132 extends back along the length of the apparatus and communicates with pneumatic cylinder 44. Pneumatic cylinder 121 of cutting blade 118 includes a coil compression spring which holds its cylinder rod in a retracted position, holding blade 118 in its up position. The coil compression spring of pneumatic cylinder 44 holds its cylinder rod 45 in its distended position, and when pressurized, the cylinder rod 45 retracts.

Operation

Ticket dispenser 10 is arranged to dispense and cut tickets on demand. For example, when a machine or operator is producing a product, the equipment or person functions to close a switch to energize the ticket dispenser. For example, when the production equipment completes a cycle, the switch controlling the electrical input to solenoid valve 108 is closed, causing air to move through solenoid valve 108, through its conduit 128 to pneumatic cylinder 104. When pneumatic cylinder 104 is pressurized, the air moves the cylinder rod 106 inwardly against the bias of the coil compression spring within cylinder 104. This causes indexing pawl 60 to move through T-shaped slot 69 of cam plate 59 and through elongated slot 64 in upper support plate 12. The coil tension spring 92 (FIG. 4) tends to hold the lower ticket engaging surface 82 of indexing pawl 60 down in engagement with the ticket material located in the passageway 55 of lower support plate 11, so that the ticket material is urged forwardly through the apparatus, so that its free end moves beyond cutting edge 120. As the indexing pawl begins its forward movement, its cam follower stems 79 and 80 engage the cam surfaces 72 and 73 of cam plate 59. This causes the cam follower stems 79 and 80 to move beneath cam plate 59, so that the weight of the cam plate is added to the downward force applied by indexing pawl 60 as it frictionally engages the ticket material.

When indexing pawl 60 moves beyond cam plate 59, its cam follower stems 79 and 80 move beyond cam surfaces 74 and 75, whereupon cam plate 59 tends to drop back into engagement with the upper surface of upper support plate 12. When indexing pawl 60 is moved by its cylinder 104 in a reverse direction, the cam follower stems 79 and 80 are moved back into engagement with cam surfaces 74 and 75 which lift indexing pawl 60 out of engagement with the ticket material, so that the cam follower stems ride over the top of cam plate 59 until they reach the enlarged head portion of the slot 69, whereupon the indexing pawl is allowed to move back down into engagement with the ticket material. Coil tension spring 92 assures rapid downward pivoting movement of indexing pawl 60 when the cam follower stems 79 and 80 clear the sides of the stem portion of the slot 69.

As indexing pawl 60 moves toward cutting means 21, the frictional engagement of its lower ticket engaging surface 82 usually tends to urge clevis 61 upwardly. In order to oppose this upward force, pawl bearing 62 is located over indexing pawl 60, and any upward movement of the indexing pawl tends to cause the indexing pawl to slide against the bottom surface of pawl bearing 62.

When indexing pawl 60 reaches the end of its feed movement, it engages micro switch 101. Micro switch 101 makes a circuit to solenoid valve 106, whereupon pressurized air is feed through conduit 129 to T-shaped fitting 130 and its outlet conduits 131 and 132. The air flowing through conduit 131 causes cutting blade 118 to move downwardly and cut the now protruding portion of the ticket material at the edge 120 of extension 115. In the meantime, the air pressure flowing through conduit 132 to pneumatic cylinder 44 causes reciprocatable feed out clevis 42 to retract out from beneath rotatable guide roll 36. As soon as clevis 42 begans its retraction, its rounded ends 51 and 52 move away from check pawl 38, whereupon check pawl 38 pivots its lower end surface 40 down into engagement with the ticket material, preventing rearward movement of the ticket material. As clevis 42 continues its retraction, it pulls the free end portion 29 of the ticket material from reel 20.

The circuitry used to actuate solenoid valve 108 includes a time out feature, so that when the proper amount of time has lapse, solenoid valve 106 and 108 vent their conduits to the atmosphere, whereupon cutting blade 118 is lifted, indexing pawl 60 is moved back to its home position, and feed out clevis 42 is moved back into its support clevis 31.

When it is necessary to resupply the ticket dispenser with another reel of ticket material, the discs 24 can be rapidly removed by unscrewing wing nut 27 from bolt 26, and new reel of ticket material placed between the discs 22 and 24, and wing nut 27 threaded back on its bolt 26. The free end of the ticket material is easily threaded between guide rolls 36 and 50, and then inserted into the slot 55 in lower support plate 11. Usually, the upper support plate 12 is pivoted upwardly during the threading procedure so that the free end portion of the new supply of ticket material can be pulled toward cutting means 21 and inserted through the short extension of the slot 55. The upper support plate is then pivoted back down into abutment with lower support plate 11, and the ticket dispenser is ready.

While this invention has been described in specific detail with particular reference to a preferred embodiment thereof, it will be understood that variations and modifications can be effected within the spirit and scope of the invention as described hereinbefore and as defined in the appended claims.

I claim:

1. Apparatus for dispensing tickets comprising an elongated lower support platform, an elongated upper support platform in parallel overlying juxtaposition with said lower support platform, an elongated ticket passageway extending between said lower and upper support platforms, reel support means mounted at one end of said lower support platform for rotatably supporting a reel of ticket material, cutting means positioned at the other end of said lower and upper support platforms, reciprocatable ticket material feed out means mounted on said lower support platform for intermittantly pulling ticket material along its length from a reel mounted on said reel support means, a check pawl for engaging and retarding movement of the ticket material toward the reel, a feed pawl reciprocatable along said passageway for engaging the ticket material and moving the ticket material along said passageway when moving toward said cutting means, cam means for moving said feed pawl out of contact with said ticket material when said feed pawl moves away from said cutting means, and control means for moving said feed pawl toward said cutting means and in response to the feed pawl reaching a predetermined position moving said material feed out means to pull additional ticket material from the reel and actuating said cutting means.

2. The apparatus of claim 1 and wherein said lower support platform and said upper support platform are pivotably connected together so that the lower and upper platforms can be moved apart to expose said elongated ticket passageway.

3. The apparatus of claim 1 and wherein said reciprocatable ticket material feed out means is movable into abutment with said check pawl to hold said check pawl out of engagement with said ticket material, and spring means for urging said check pawl toward engagement with said ticket material.

4. The apparatus of claim 1 and wherein said upper platform defines a platform slot aligned with said ticket passageway, said cam means comprises a cam plate movably mounted to said upper platform and defining a cam slot aligned with said platform slot, said feed pawl being movable through said platform slot and said cam slot, said cam slot including first cam surfaces shaped to urge said feed pawl down into said platform slot and into said ticket passageway to urge the ticket material along said ticket passageway when said feed pawl moves toward said cutting means and second cam surfaces shaped to lift said feed pawl upwardly away from the ticket material when said feed pawl moves away from said cutting means.

5. The apparatus of claim 4 and wherein said cam slot is approximately T-shaped

6. The apparatus of claim 4 and further including spring means for biasing said feed pawl into said ticket passageway and toward engagement with the ticket material in said ticket passageway.

7. Apparatus for dispensing tickets comprising elongated lower and upper support platforms mounted in parallel overlying juxtaposition, an elongated ticket passageway defined between said lower and upper support platforms, ticket cutting means positioned at one end of said lower and upper platforms, a feed pawl opening formed through said upper support platform and extending along said ticket passageway, a feed pawl movable back and forth along said feed pawl opening toward and away from said cutting means, means for urging said feed pawl into frictional engagement with ticket material in said ticket passageway as said feed pawl moves toward said cutting means and means for urging said feed pawl out of frictional engagement with said ticket material in said ticket passageway as said feed pawl moves away from said cutting means, ticket material feed out means positioned at the other end of said lower and upper platforms, said feed out means including a check pawl pivotable toward engagement with the ticket material for preventing movement of the ticket material away from said cutting means and means for pulling ticket material from a supply, control means for first moving said feed pawl toward said cutting means for pushing a length of ticket material beyond said cutting means, and in response to said feed pawl having moved a predetermined distance toward said cutting means, actuating said cutting means to cut the ticket material and actuating said ticket material feed out means to pull ticket material from a supply.

* * * * *